United States Patent [19]

Ying et al.

[11] Patent Number: 4,558,651

[45] Date of Patent: Dec. 17, 1985

[54] FIRED HEATER FOR COAL LIQUEFACTION PROCESS

[75] Inventors: David H. S. Ying, Macungie; Wayne T. McDermott, Allentown; Edwin N. Givens, Bethlehem, all of Pa.

[73] Assignee: International Coal Refining Company, Allentown, Pa.

[21] Appl. No.: 543,639

[22] Filed: Oct. 19, 1983

[51] Int. Cl.[4] ..... F23D 1/00; C10G 1/06

[52] U.S. Cl. ..... 110/347; 208/8 R; 208/10; 110/229

[58] Field of Search ..... 110/347, 238, 229; 432/29, 196, 197; 208/8 R, 10

[56] References Cited

U.S. PATENT DOCUMENTS

| | | | |
|---|---|---|---|
| 3,855,070 | 12/1974 | Squires | 208/8 R |
| 3,884,794 | 5/1975 | Bull et al. | 208/8 R |
| 3,884,796 | 5/1975 | Hinderliter et al. | 208/8 R |
| 3,950,146 | 4/1976 | Funk | 110/229 |
| 3,951,615 | 4/1976 | Gernhardt et al. | 110/229 |
| 3,997,423 | 12/1976 | Greene | 208/11 R |
| 4,012,311 | 3/1977 | Greene | 208/8 R |
| 4,069,020 | 1/1978 | Bond et al. | 432/29 |
| 4,411,767 | 10/1953 | Garg | 208/10 |
| 4,473,459 | 9/1984 | Bose et al. | 110/229 |

*Primary Examiner*—Henry C. Yuen

[57] ABSTRACT

A fired heater for a coal liquefaction process is operated under conditions to maximize the slurry slug frequency and thereby improve the heat transfer efficiency. The operating conditions controlled are (1) the pipe diameter and pipe arrangement, (2) the minimum coal/solvent slurry velocity, (3) the maximum gas superficial velocity, and (4) the range of the volumetric flow velocity ratio of gas to coal/solvent slurry.

10 Claims, 2 Drawing Figures

FIRED HEATER FOR COAL LIQUEFACTION PROCESS

The Government of the United States of America has rights in this invention pursuant to Contract No. DE-AC05-780R03054 (as modified) awarded by the U.S. Department of Energy.

BACKGROUND OF THE INVENTION

This invention relates generally to an improved fired heater for a coal liquefaction process. More particularly, this invention relates to a method of operating a fired heater for a coal liquefaction process so as to improve the heat transfer efficiency thereof.

In the conversion of coal to synthetic fuels by direct liquefaction, the coal is mixed with a recycle solvent and is hydrogenated in a three phase reactor at temperatures in the range of 750°–880° F. (399°–471° C.) and pressures in the range of 1000–3000 psi ($6.89\times10^7-2.07\times10^8$ dynes/cm$^2$). In a direct coal liquefaction process, for example the SRC-I process, coal is mixed with solvent at low temperature (typically from 100°–450° F.) (38°–232° C.) at atmospheric pressure. The resulting slurry is pumped to a high pressure, for example, 2500 psi ($1.72\times10^8$ dynes/cm$^2$) and is then preheated in heat exchangers to a temperature of approximately 500° F. (260° C.) Hydrogen gas is then added to form a three phase mixture of hydrogen/coal solvent which is heated to a temperature of 650°–800° F. (343°–427° C.) in a fired heater by passing the mixture through a pipe having a very long length to diameter ratio. The preheated three phase mixture is then passed to a reactor vessel in accordance with the SRC-I process.

The fired heater is a critical component in a process for the direct liquefaction of coal. Because of the high operating pressure and temperature and the erosive/corrosive nature of the coal slurry, expensive materials are required for the fired heater making this unit a major cost item in the coal liquefaction process.

As stated above, the function of the fired heater is to heat the hydrogen/coal/solvent three-phase mixture flowing from the slurry preparation stage to the dissolver. The fuel required to heat the feed to reaction temperature is a major expense in any coal processing plant. In order to minimize the total energy load required for preheating and thereby reduce the fuel requirements of a plant, heat exchangers may be injected into the feed system to raise the temperature to as high a level as possible by using heat generated from other areas of the plant from various cooling steps. Heat transfer media or suitable substitutes are commonly used to effect such heat transfer from one location to another. However, it is still necessary that considerable heat be added to even a pre-warmed slurry to get it up to reaction temperatures.

In coal liquefaction plants the efficiencies in the fired heater both in equipment and fuel requirements can have a major impact on the cost of building and operating such a plant. Since the process operates at high pressures, very expensive equipment is required to contain the very corrosive reaction media. The major cost associated with the fired heaters based upon heaters having nearly the same level of heat input is the length and size of the fired heater tube. Generally, the shorter the tube length at constant heat input the less expensive the total fired heater. Alternatively, for the same tube length, the heating rate to the fired box can be turned down to reduce fuel expense. The behavior of three-phase mixtures flowing through such systems at high heat fluxes also constrains the size and shape of these tubular systems. On the one hand, utilizing a system with a large tubular diameter will result in diminished heat transfer to the reaction media. On the other hand, using a diameter which is quite small will result in problems associated with very high erosion rates within the tubes brought on by the very rapid movement of the slurry through the pipe.

Fired heaters can be of several configurations. The pipes can run in horizontal or near-horizontal configurations slowly spiraling upward as the pipe winds its way around a circular or race track type pathway. Because of the long lengths of pipe often used, the height of such units becomes quite large, and because of the costs associated with erecting high structures, a cost incentive exists to minimize the overall height of these structures.

Another configuration used in these fired heaters is an up and down pattern resembling an upright radiator and comprised of a series of hairpin turns at the top and bottom. Because of problems associated with materials that could accumulate in the lower bends such as design is less favorable for use in a coal liquefaction plant.

It is known in the art of coal liquefaction to utilize the horizontal or near-horizontal design. Likewise the art has comtemplated that operation of a preheater system need not be restrained over the overall operating range that a plant may experience. In U.S. Pat. No. 3,884,794 a coal liquefaction process is disclosed in which hydrogen may be passed to the preheater at a rate from 200 to 10000 SCF/Barrel (35.6–1779.9 scm/m$^3$) of feed. This corresponds to approximately 1300 to 65000 SCF/ton ($4.06\times10^{-2}-2.03$ scm/Kg) of coal at 40% coal slurry concentration. The overall operation of the preheater is contemplated to occur at ratios of gas to slurry through the preheater of 0.2/1 to 13/1.

The inventors have found that when a gas-slurry system flows through a horizontal or near-horizontal pipe at gas superficial velocities from 1 to 20 ft/sec (0.30–6.10 m/sec) and slurry superficial velocities greater than 1 ft/sec (0.30 m/sec), slug flow occurs. Slug flow refers to a behavior of the mobile phase in the pipe wherein the slurry phase will intermittently bridge the cross-sectional area of the pipe. Most of the time the top section of the pipe will be in contact with "slugs" of gas which are moving through the system. Heating the contents of the pipe would be far more efficient if the slugs of gas could be eliminated thereby allowing the slurry to completely fill the pipe bridging the cross-sectional area as it progresses through the preheater from one end to the other. Such a mode of operation puts slurry in contact with the walls most of the time thereby increasing heat transfer.

Unfortunately, in coal liquefaction preheaters in which three-phase flow must occur such completely flooded pipe designs are not acceptable. Froth flow would accomplish such a desired uniform flooding effect, but such behavior can be accomplished only at very high velocities where erosion by the particulate material would be severely limiting. It is known to those skilled in the art of heat transfer and fluid mechanics that higher heat transfer will also occur at higher frequencies for systems operating in a slug flow mode. These higher slug frequencies are also accompanied by higher slurry linear velocities through the tube which means that at higher slurry rates through the pipe heat transfer per surface area of the pipe will be more efficient.

Under all circumstances some hydrogen must be in contact with the flowing slurry in order to retard the coking that often happens in its absence. Therefore, since some gaseous hydrogen must be present, it is desirable to minimize the gaseous phase to as low a level as possible for acceptable operation in order to maximize heat transfer by maximizing contact of the slurry with the total pipe wall surface. Based on the fact that some hydrogen gas must be present, higher heat transfer is also helped by maintaining high slug frequencies in the pipe. This promotes frequent complete bridging of the pipe diameter.

SUMMARY OF THE INVENTION

It is the general object of the invention to provide an improved fired heater which is operated so as to increase the frequency of slugs flowing through the pipe to thereby improve the heat transfer efficiency of the heater.

The improved fired heater of the invention has been arrived at as a result of experiments and analysis of the effects of slug flow on the heating efficiency thereof. At any particular flow rate of slurry through a pipe, the less the gaseous void volume within the pipe, the higher the heat transfer efficiency of the pipe. The slowing of the velocity of slurry decreases the thermal efficiency and adds the problem of potential solids deposition within the tube. Pursuant to the invention it has been determined that the minimum slurry velocity through the pipe should be no less than five feet per second (1.52 m/sec).

Moreover, it has been determined that when the slurry velocity through a pipe is increased and the gas velocity is held constant, the slug frequencies increase. Quite surprisingly, experiments performed leading up to the present invention indicated that slug frequencies increased significantly only for pipes less than six inches (15.2 cm) in diameter. For pipes less than six inches in diameter, the heat transfer rate would be higher, which then makes these pipes preferable to larger diameter pipes in which no such advantage would be observed.

It has been determined that the preferred fired heater of the invention has the following characteristics:

(1) The coal/solvent slurry is passed through either a horizontal pipe or a pipe inclined slightly in the direction of flow;

(2) The coal/solvent slurry is passed through the pipe at a velocity greater than five feet per second (1.52 m/sec) and less than twenty-five feet per second (7.62 m/sec);

(3) The pipe diameter of the fired diameter is less than six inches (15.2 cm);

(4) The gas superficial velocity is less than three feet per second (0.91 m/sec); and (5) The volumetric flow velocity ratio of gas to coal/-solvent slurry is between 0.1 and 0.7.

With a fired heater operated pursuant to items (1)–(5) above, the hydrogen-rich feed gas to coal slurry ratio would be from 500–3500 SCF/ton (89–623 scm/m$^3$) at 40% concentration in feed slurry. This range would change as the coal concentration changes.

Other design and operating parameters of a fired heater in accordance with the invention are as follows:

(6) The pipe length to diameter ratio is greater than 100 to 1;

(7) The residence time within the heater is ten minutes or less; and (8) The outlet temperature of the heater is 650°–800° F. (343°–427° C.).

DETAILED DESCRIPTION OF THE PREFERRED EMBODIMENT

As a result of experimental work associated with the above-mentioned contract, it was determined that increasing the liquid superficial velocity in a gas/liquid two-phase flow through a horizontal three inch pipe resulted in an increase of the slug frequency. Furthermore, it is concluded that in an actual fired heater pipe the same phenomena would occur. Moreover, it is well known that for laminar flow, heat transfer is proportional to the square root of slug frequency. Hence, by increasing the coal/solvent slurry velocity in a fired heater, the heat transfer rate will be increased thereby improving the energy efficiency in a fired heater.

In addition, from various studies it was determined that increased liquid velocity increased slug frequency. The results from a cold-flow simulation study using an air/water system in a three inch diameter Plexiglas pipe is shown in Table 1:

TABLE 1

| Gas Superficial Velocity | | Liquid Superficial Velocity | | Slug Frequency |
|---|---|---|---|---|
| (ft/sec) | (m/sec) | (ft/sec) | (m/sec) | (sec$^{-1}$) |
| 3 | (0.91) | 1.49 | (0.45) | 0.32 |
| 3 | (0.91) | 2.90 | (0.88) | 0.81 |
| 3 | (0.91) | 5.21 | (1.59) | 1.73 |

Table 1 illustrates that the slug frequency rate increased very substantially as the liquid superficial velocity increased from about 1.5 feet per second (0.46 m/sec) to about 5.2 feet per second (1.58 m/sec) at a constant gas superficial velocity of three feet per second (0.91 m/sec). These data established the basic premise of the fired heater design and operation in accordance with the invention wherein increased slurry velocities give rise to higher slug frequencies.

For purposes of this invention, it is understood that "superficial velocity" is defined in terms of volumetric flow rate divided by total cross-sectional flow area.

Further, Table 2 shows the increase in the heat transfer rate based on the data of Table 1, it being noted that the heat transfer coefficient is proportional to the square root of slug frequency for laminar slug flow, as follows:

TABLE 2

| Change in liquid superficial velocity (ft/sec [m/sec]) | | Heat Transfer Rate |
|---|---|---|
| From | To | increases by a factor of |
| 1.49 (0.45) | 2.90 (0.88) | 1.59 |
| 1.49 (0.45) | 5.21 (1.59) | 2.33 |
| 2.90 (0.88) | 5.21 (1.59) | 1.46 |

The above-described simulation study showed that a slight pipe inclination of one degree causes a definite increase in slug frequency. Thus, for the slurry velocities of the magnitude shown in Table 1, the one degree inclined pipe would give higher slug frequencies than the horizontal pipe.

Figure 2:
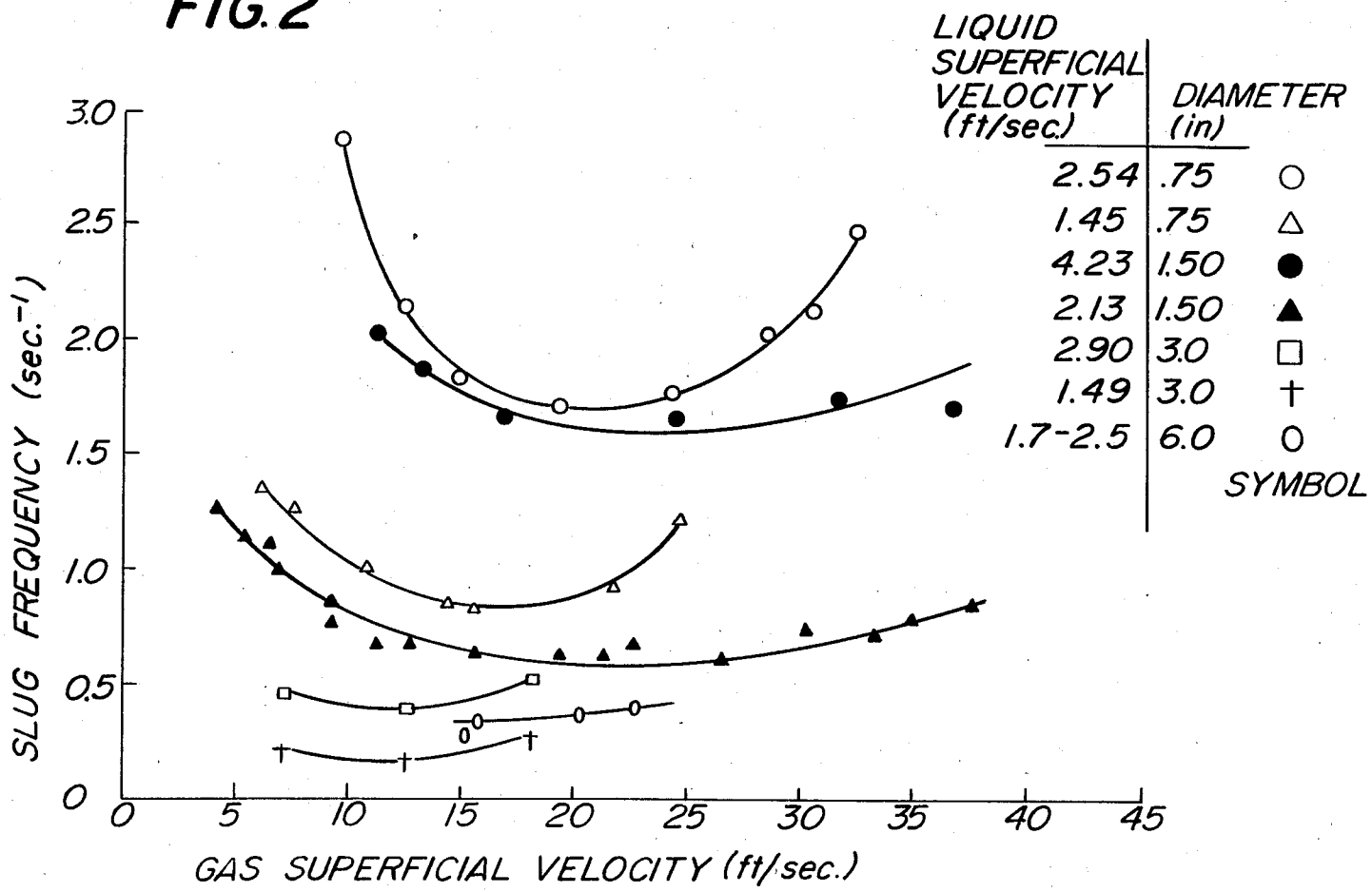
FIG. 2 is a graph showing the relationship between slug frequency and gas velocity for various pipe diameters and liquid velocities.

The effect of pipe diameter on slug frequency is illustrated in FIG. 2. The data in this figure show that for pipes of three inch diameter or less, a higher velocity clearly gives higher slug frequency whereby it is concluded that the heat transfer rate would improve. Also, FIG. 2 shows that, at the same gas and liquid velocities, the slug frequency increases substantially with decreasing pipe diameter. For example, at ten feet per second (3.05 m/sec) gas velocity, the slug frequency increases from 0.4 $sec^{-1}$ to 2.8 $sec^{-1}$, a seven fold increase, when the pipe diameter reduces from 3.0 inches (7.6 cm), i.e., 2.90 feet per second (0.88 m/sec) fluid velocity, to 0.75 inches (1.9 cm), i.e., 2.54 feet per second (0.77 m/sec) fluid velocity. This corresponds to an increase of heat transfer rate by a factor of 2.65. For constant volume slurry flow rate and gas superficial velocity, the increase in heat transfer rate will be higher as the pipe diameter is reduced because the slurry superficial velocity in the smaller pipe will be much higher thereby further enhancing the heat transfer rate.

It is to be noted that the gas holdup in the fired heater pipe will be decreased significantly as the gas velocity is reduced. By decreasing gas at a desired slurry residence time, the amount of piping that will be necessary in the preheater will be substantially decreased. For example, a 40% gas holdup reduction will result as the superficial gas velocity changes from ten feet per second to three feet per second. This gas holdup reduction would save 40% of the required piping. Hence, the size of the fired heater box would be substantially reduced.

The initial preheater design for the 6000 TPD ($5.44\times10^6$ Kg PD) SRC-I demonstration plant employs six 8-inch nominal pipes (6.8 in. (17.3 cm) I.D.). The corresponding slurry and hydrogen superficial velocities are 3.8 ft/sec (1.16 m/sec) and 6.3 ft/sec (1.92 m/sec), respectively. A potential design based upon this invention is to use four 6-inch (15.2 cm) nominal pipes (5.2 in. (13.2 cm) I.D.) and to reduce the hydrogen gas fed to the preheaters to 3 ft/sec (0.91 m/sec) maintaining a ratio of gas volumetric velocity to coal-solvent slurry velocity between 0.1 and 0.7. Although the slug frequency data for 8-inch (20.3 cm) and 6-inch (15.2 cm) nominal pipes are not directly available, the advantage of this potential design can be estimated based on the data of Tables 1 and 2. This suggested preheater design provides a three-fold increase in slurry velocity over the initial design and the heat transfer rate will be enhanced by more than a factor of two in a laminar slug flow regime. This estimated heat transfer efficiency improvement does not take into account the further advantage of slug frequency enhancement due to the reduction of pipe size. The exact heat input to the fired box and the piping requirement can be optimized to make use of the full advantage of the improved heat transfer rate. This energy-efficient design provides savings on heat duty, the capital cost of piping, and the number of fired boxes required.

Figure 1:
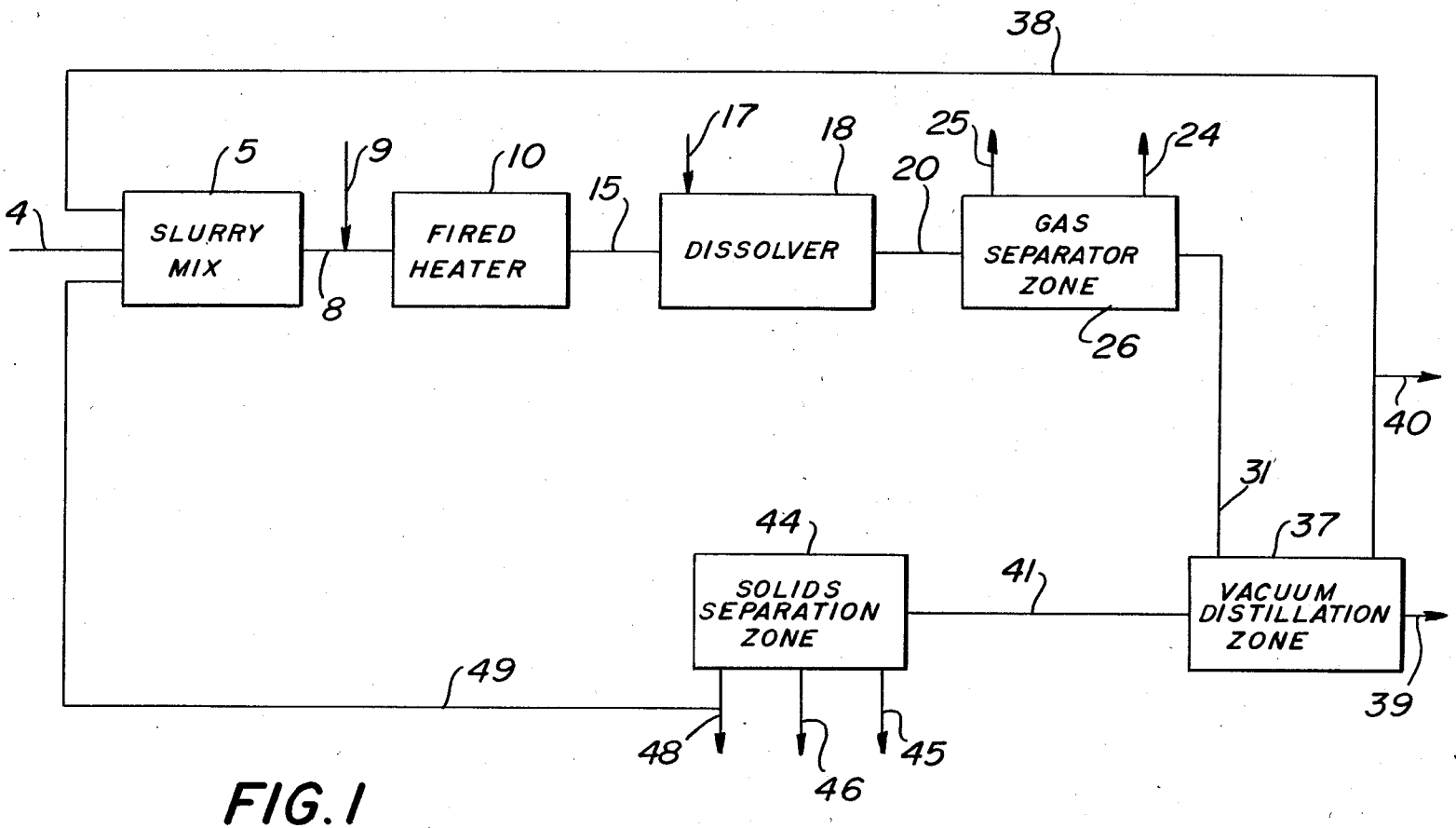
FIG. 1 is a schematic view of an SRC-I process incorporating a fired heater of the invention.

In FIG. 1 there is shown a schematic illustration of part of an SCR-I process to which the fired heater of the invention is applicable. An example of the invention will now be described with respect to the SRC-I process shown in FIG. 1.

Referring to FIG. 1, the process comprises passing particulate coal to a mix tank 5 through a line 4 where a slurry is formed with a pasting solvent that may be a coal derived oil, obtained in the coking of coals in a slot oven, commonly referred to as creosote oil, anthracene oil or of equivalent type, or the solvent may be a process derived solvent having a boiling range of about 350° to 1000° F. (177°-538° C.). The slurry mix tank can be maintained at temperatures from ambient to 450° F. (232° C.) by controlling the temperature of the distillate solvent recycled from the vacuum distillation section 37 through line 38 and the residual SCR materials recycled from the solids separation zone 44 through line 49. In the slurry mix tank, moisture entrained in the feed coal may be removed if desired by maintaining the temperature in the tank at an elevated level while allowing the moisture to escape as steam. The slurry from the slurry mix tank 5 is passed to a pumping unit which is not shown that forces the slurry into a system maintained at high pressures of from 500 to 3200 psig ($3.55\times10^7-2.22\times10^8$ dynes/$cm^2$), in line 8. The high pressure slurry in line 8 is mixed with hydrogen rich gas from line 9 and the three-phase gas/slurry stream is introduced into a preheater system fired heater 10 where the temperature is rapidly increased. In the fired heater 10 the gas/slurry mixture is passed through a long length of pipe which is exposed to high temperatures from an external source. Heat is transferred to the contents passing through the pipe raising the temperature of the three-phase mixture to a level of 650°-800° F.) Fired heater 10 is constructed and operated pursuant to the parameters of the present invention to provide a high slug frequency to maintain a high heat transfer efficiency.

The exit slurry in line 15 from the preheater 10 which contained only a small portion of the original coal that remains undissolved enters the dissolver vessel 18. At this point additional fresh hydrogen rich gas is introduced through line 17 into the dissolver vessel 18. The slurry in the dissolver vessel undergoes various catalytic reactions. The size of the dissolver vessel is considerably larger than that employed in the preheater section of the system. The coal and process solvent undergo a number of chemical transformations in the dissolver vessel including but not necessarily limited to: further dissolution of the remaining undissolved coal in the liquid, hydrogen transfer from the process solvent to the coal rehydrogenation of the process solvent, removal of heteroatoms (S, N, O) from the coal products and the process solvent, reduction of certain components of the coal ash, such as pyrite to pyrrhotite, and hydrocracking of heavy coal liquids.

The superficial flow through the dissolver vessel 18 will generally be at a rate from 0.003 to 0.1 feet per second ($9.1\times10^{-4}-3\times10^{-2}$ m/sec) for the condensed slurry phase and 0.05 to 5 feet per second ($1.52\times10^{-2}-1.52$ m/sec) for the gas phase. These rates are chosen in order to maintain good agitation in the reactor which insures good mixing. The ratio of total hydrogen gas to slurry is maintained at a level to insure an adequate hydrogen concentration in the exit slurry of at least 50 mole percent and more preferably, greater than 70 mole percent.

The dissolver zone 18 is connected to the downstream equipment by line 20. The gas slurry flow of solvent refined coal passes from the overhead of the dissolver zone 18 through line 20 into a high pressure separator system 26 in which the gaseous effluent is separated from the condensed phase. This gas phase separation is conducted in a series of flash separating zones. The gas phase is passed from the separation zone 26 through line 24 to a gas separation and purification area, which is not shown, where hydrogen enriched gases are separated and purified and passed to the preheater section 10 and the liquefaction zone 18 through lines 9 and 17, respectively. The light gases which are recovered include hydrogen, carbon monoxide, carbon dioxide, ammonia, water and low molecular weight hydrocarbons such as methane, ethane, propane and butane. As stated above, the hydrogen can be recycled to the upstream equipment in line 9 and 17 to provide the reducing atmosphere for the coal liquefaction operation and the low molecular weight hydrocarbons may be recycled to provide fuel for temperature maintenance such as that required in the fired heater 10.

The remaining effluent consisting of a liquid/solid slurry is then deashed. Any of the liquid/solid separation techniques known in the art may be employed, such as filtering, centrifugation, hydrocloning, solvent deashing and antisolvent deashing. Essentially all of the solid ash and undissolved coal particles are removed. Distillation may be practiced either before of after solid separation to recover recycle solvent. In the system shown in FIG. 1, the solids separation occurs downstream of the vacuum distillation zone. The liquid/solid slurry product from zone 26 is passed to a vacuum distillation zone 37 through line 31. In this stage, three streams of product are obtained; a light distillate stream with a boiling point up to 400° F. (204° C.), a heavy distillate stream with a boiling range of 350° F. (177° C.) to 1,000° F. (538° C.) and a solvent refined coal stream with some process solvent with an initial boiling point of about 850° F. (454° C.). The light distillate fraction is passed from the distillation zone 37 through line 39 to product storage which is not shown. The heavy distillate solvent is passed from the vacuum distillation zone 37 through line 38 as recycle to the slurry mix tank 5 and to export as product in line 40. This process solvent stream is recycled to the coal feed stream to help make the initial coal recycle solvent slurry. Finally, a bottoms material which contains soluble solvent refined coal, unconverted coal macerals and mineral matter is passed to the solid separation zone 44 through line 41. The solid insoluble material is removed from the solid separation zone 44 through line 45 where the solid material may be passed to a gasifier to generate hydrogen if so desired. Deashed products having various compositions, specifically high and low levels of benzene insolubles, are produced. These high and low level benzene insoluble products are passed to storage through lines 46 and 48, respectively. Part of the low level benzene insoluble product can be recycled to the slurry mix tank 5 through line 49.

What is claimed is:

1. A method of operating a fired heater for heating a three-phase mixture of hydrogen gas and a coal/solvent slurry flowing from a slurry preparation stage to a dissolver stage in a coal liquefaction process comprising:

(1) passing the three-phase mixture through the fired heater by way of a substantially horizontal pipe;

(2) passing the coal/solvent slurry through said pipe at a superficial velocity greater than 5 feet per second (1.52 m/sec) and less than 25 feet per second (7.62 m/sec);

(3) the pipe diameter being less than 6 inches (15.2 cm);

(4) maintaining the gas superficial velocity to be less than 3 feet per second (0.91 m/sec); and (5) maintaining the volumetric flow velocity ratio of gas to coal/solvent slurry between 0.1 and 0.7.

2. A method according to claim 1 wherein the pipe length to diameter ratio is greater than 100 to 1.

3. A method according to claim 1 wherein the residence time within the heater is 10 minutes or less.

4. The method according to claim 1 wherein the outlet temperature of the heater is 650°–850° F. (343°–454° C.).

5. The method according to claim 1 wherein the pipe length to diameter ratio is greater than 100 to 1 and the residence time within the heater is 10 minutes or less.

6. The method according to claim 1 wherein the pipe is inclined at an angle in the direction of flow of approximately one degree.

7. A method according to claim 6 wherein the pipe length to diameter ratio is greater than 100 to 1.

8. A method according to claim 6 wherein the residence time within the heater is 10 minutes or less.

9. The method according to claim 6 wherein the outlet temperature of the heater is 650°–850° F. (343°–454° C.

10. The method according to claim 6 wherein the pipe length to diameter ratio is greater than 100 to 1 and the residence time within the heater is 10 minutes or less.

* * * * *